US005494055A

United States Patent [19]

Noe et al.

[11] Patent Number: 5,494,055

[45] Date of Patent: Feb. 27, 1996

[54] AROMA MIXTURES FOR INCORPORATION INTO COVERINGS FOR SMOKEABLE TOBACCO GOODS

[75] Inventors: Hans Noe, Quickborn; Gunther Peters, Buchholz, both of Germany

[73] Assignee: H. F. & Ph. F. Reemtsma GmbH & Co., Hamburg, Germany

[21] Appl. No.: 173,353

[22] Filed: Dec. 23, 1993

[30] Foreign Application Priority Data

Dec. 24, 1992 [DE] Germany ..... 42 44 467.5

[51] Int. Cl.[6] ..... A24D 1/02

[52] U.S. Cl. ..... 131/365; 131/276; 131/278

[58] Field of Search ..... 131/276–278, 131/365, 274; 546/348

[56] References Cited

U.S. PATENT DOCUMENTS

| | | | |
|---|---|---|---|
| 3,550,598 | 12/1970 | McGlumphy | 131/335 X |
| 3,769,040 | 10/1973 | Pittet et al. | 131/278 X |
| 4,225,636 | 9/1980 | Cline et al. | 131/365 X |
| 4,804,002 | 2/1989 | Herron | 131/365 |
| 5,148,817 | 9/1992 | Houminer et al. | 131/278 |

*Primary Examiner*—Jennifer Bahr

*Attorney, Agent, or Firm*—Foley & Lardner

[57] ABSTRACT

An aroma mixture for reducing undesired side-stream smoke effects, comprising: (a) one or more aldehydes, selected from the group consisting of saturated, mono- and polyunsaturated aliphatic, alicyclic and aromatic aldehydes containing 4 to 12 carbon atoms; (b) one or more heterocyclic compounds which contain oxygen or nitrogen as hetero atom(s) and at least one hydroxy group or one methyl group, selected from the group consisting of mono- and oligocyclic heterocycloalkanes, heterocycloalkenes and heteroaromatics; and (c) vanillin (4-hydroxy-3-methoxy benzaldehyde).

12 Claims, No Drawings

AROMA MIXTURES FOR INCORPORATION INTO COVERINGS FOR SMOKEABLE TOBACCO GOODS

FIELD OF THE INVENTION

The invention relates to aroma mixtures and cigarettes, tobacco cartridges (fine-cut twist) and filter tubes containing these aroma mixtures either applied to cigarette paper or tobacco cartridge covering material, or incorporated into the paper or cellulose material to reduce the undesirable effects associated with side-stream smoke.

BACKGROUND OF THE INVENTION

When tobacco goods are smoked, two streams of smoke are produced. Main-stream smoke (MSS) is the smoke stream formed during the draw; side-stream smoke (SSS) is the smoke stream generated at the burning point of the tobacco in the interval between draws. Details and other definitions are contained in DIN/ISO 4387 and the paper by Neurath and Ehmke: "Apparatur zur Untersuchung des Nebenstromrauches", published in "Beiträge zur Tabakforschung 2"(1964) 117–121, to which reference is made here.

The odor of cigarette smoke is generally considered to be unpleasant by non-tobacco users. However, smoke overlaid or over-aged by side-stream smoke, known as "cold" smoke, is unusually objectionable to smokers and non-smokers alike. Non-smokers find several properties of this cold smoke to be particularly repellent. These objectionable properties include both the smell of the cold smoke, essentially, a "stale, bad odor" and irritation to the eyes and nose of particularly sensitive individuals.

Various attempts have been made to counteract these unpleasant nuisances, mainly via additives. These additives have the effect of simultaneously changing the taste of the main-stream smoke while affecting nuisance odors. The effect of the additives on the taste of the main-stream smoke represents a disadvantage in the form of limited freedom in cigarette design. A typical example of this is given in U.S. Pat No. 4,638,816, in which the additives added to the tobacco alter both the tobacco taste of the main-stream smoke and the odor of the side-stream smoke toward vanilla in each case; another example is EP-A 0 294 972, according to which similar effects are to be achieved by means of additives incorporated into the cigarette paper.

It is also known in the art, from DE-AS 1 771 622, that microcapsules containing flavorings or fragrances may be applied to the cigarette paper. The known microcapsules have a diameter of 5 to 100 μm and are expediently placed on the side of the paper facing the tobacco. Disadvantages associated with this method include the form in which the microcapsules are applied, leading to a reduction in the porosity of the cigarette paper, and the size of the capsules, which can exceed the thickness of usual cigarette papers by up to three times. From the outset, size and arrangement of the capsules impede convenient processing of this type of cigarette papers because the capsules are prematurely destroyed by fast-running manufacturing machines. Cigarettes produced from cigarette papers supplied with microcapsules also have a tendency to form undesired spots and condensate stripes when the cigarette is smoked. In addition, the flavours used overlay or alter the original cigarette taste or smell with a certain odor or taste.

A need persists for a cigarette and cigarette tube, and analogously a tobacco cartridge and tobacco cartridge covering, with increased side-stream smoke acceptance while avoiding the disadvantages of the known processes, i.e. the side-stream smoke forming from this cigarette should develop a scent which, even after a prolonged time, is pleasantly tobacco-like, but as inconspicuous and weak as possible, free from irritant factors, and in no case substantially alters the taste of the main-stream smoke. At the same time, a convenient method of processing the tobacco strand or rod coverings, and a usual burn behavior of this cigarette, are provided.

SUMMARY OF THE INVENTION

The invention concerns aroma mixtures for incorporation into coverings for smokeable tobacco goods that reduce undesirable effects of side-stream smoke. Such an aroma mixture is effective to give side-stream smoke a weak, non-irritating, pleasantly tobacco-like odor without altering the taste of the main-stream smoke. In selecting the flavours or fragrances, the fact that the distribution of volatile substances in the main and side-stream smoke is dependent among other things on physicochemical parameters was taken into consideration (T. Samejina et. al. TCRC 1985). It was found according to the invention that fragrances or flavors with the common feature of boiling points between 80° C. and 250° C., preferably between 130° C. and 160° C., are particularly well suited to achieve the effect according to the invention. Furthermore, this effect was also established with fragrances which sublimate or are volatile in steam. An aroma mixture according to the invention thus comprises one or more aldehydes of lower hydrocarbons, one or more heterocyclic compounds containing oxygen or nitrogen as hetero atom(s), and vanillin (4-hydroxy-3-methoxy benzaldehyde) or derivatives thereof having comparable fragrance properties, the ingredients of the mixture having boiling points between 80° C. and 250° C., preferably between 130° C. and 160° C. The invention may be used in the production of cigarettes and cigarette tubes, and analogously in tobacco cartridges and tobacco cartridge coverings.

DETAILED DESCRIPTION OF PREFERRED EMBODIMENTS

To achieve a tobacco product with reduced odor and irritants from side-stream smoke, a preferred aroma mixture used to treat cigarette papers and other wrappings for tobacco products comprises:

(a) one or more aldehydes, selected from the group consisting of saturated, mono- and polyunsaturated aliphatic, alicyclic and aromatic aldehydes containing 4 to 12 carbon atoms;

(b) one or more heterocyclic compounds which contain oxygen or nitrogen as the hetero atom(s) and at least one hydroxy group or methyl group, selected from the group consisting of mono- and oligocyclic heterocycloalkanes, heterocycloalkenes and heteroaromatics; and (c) vanillin (4-hydroxy-3-methoxy benzaldehyde), and optionally:

(d) one or more alcohols containing 7 to 12 carbon atoms, selected from the group consisting of saturated, mono- and polyunsaturated aliphatic, alicyclic and aromatic alcohols, (e) carboxylic acid esters of the general formula

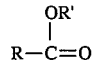

where R is the group derived from carboxylic acids consisting of 2 to 8 carbon atoms and R' is the alkyl group of the alkoxy grouping consisting of 1 to 5 carbon atoms, (f) saturated carboxylic acids containing 4 to 6 carbon atoms, (g) aroma extracts, (h) heliotropin (3,4-(methylenedioxy) benzaldehyde)

(i) maltol (3-hydroxy-2-methyl-4-pyrone), (j) nicotine (3-(1-methyl-2-pyrrolidinyl) pyridine).

Aroma extracts can be made by solvent extraction or $CO_2$ extraction according to known methods from spices including cinnamon, vanilla, iris-root, cloves, caraway seeds, cacao shells, cacao, helichrysum angustifolium, and foenogreek.

Ingredients (a) to (c) provide a mixture that achieves the desired effects according to the invention. The optional compounds (d) to (j) to be used can, in addition to the basic aroma mixture, be used singly or in combination to make the aroma more complete and enable a broader differentiation of the achieved aromatic flavor. The relative amounts of each ingredient vary depending on the desired aroma and are not critical. In general, the total amount of (a) to (j) may be up to about 57 percent by weight, preferably up to about 40 percent by weight, of a mixture according to the invention for application to a cigarette paper, with the balance being a volatile, non-toxic solvent or diluent such as ethanol. The ingredients can be applied in encapsulated or in unencapsulated form, into or onto either a single-layered cigarette rod covering or a special, double-layered cigarette rod covering respectively. A particularly preferred aroma mixture according to the invention consists essentially of 2.0–7.5% 4-hydroxy-2,5-dimethyl-3(2H)-furanone (Furaneol®), 1.5–3.5% vanillin, 0.5 to 5.0% heliotropin, 0.05–0.3% vanitrop (trans-2-ethoxy-5(1-propenyl) phenol), 0.4–1.5% homofuranol, 0.1 to 1.0% benzaldehyde, 0.5–4.0% cinnamon extract, 1.0–4.0% anisaldehyde, 5.0–22.0% cumarin flavor, 2.0–8.0% 1,2-propylene glycol, and the balance ethanol.

Suitable for producing tobacco goods with reduced undesired effects triggered by side-stream smoke are, e.g., tobacco cartridges (fine-cut twist) or filter tubes onto which the aroma mixtures, according to the invention, have been applied. With cigarettes themselves, the aroma mixture is preferably applied to the cigarette rod covering during the production process for the manufactured cigarette. The preferred amount of the aroma mixture to be applied for achieving the desired effect are between about 0.01 and 5 mg per cigarette, preferably between about 0.02 and 1.5 mg per cigarette.

For cigarettes containing a tobacco rod with a single-layered or double-layered cigarette rod covering, the aroma mixture according to the invention is applied in encapsulated or unencapsulated form directly onto the cigarette rod covering. With single-layered cigarette rod coverings, the mixtures are applied either in encapsulated or unencapsulated form, directly onto the cigarette paper used.

For cigarettes with a two-layered cigarette rod covering, the outer, visible layer consists of cigarette paper customarily per se having an air permeability of 3 to 150 CORESTA, preferably 5 to 100 CORESTA and most preferably 10 to 60 CORESTA. This outer layer of cigarette paper can, as with single-layered cigarette rod coverings, serve to receive the aroma mixtures in encapsulated or unencapsulated form. The inner, non-visible layer which consists of a highly porous fine-mesh cellulose fibre grid (tobacco cartridge covering material, K paper), or highly porous paper fleece with an air permeability in the untreated condition, i.e. prior to a possible application of fragrances or of microcapsules containing fragrances, of 4000 to 80,000 CORESTA, preferably 10,000 to 50,000 CORESTA, serves in a most preferred form as the layer carrying the aroma mixtures.

The porosity of the inner layer is 2,000 to 30,000 CORESTA after applying the capsules by coating or similar processes onto the fine-mesh cellulose fibre grid or highly porous paper fleece, or when incorporating the capsules into the material which is used for the paper production. As a general rule, values between 1:10 and 1:1000 apply for the porosity ratio to be set for the two paper layers in order to guarantee control of the burn-off behavior of the cigarette through the outer layer alone.

The porous, fine-mesh cellulose fibre grid (tea bag-like paper, highly porous covering paper or highly porous paper fleece) as carrier of the encapsulated aromas can be processed in one step, i.e. through simultaneous covering of the tobacco with both papers to form the cigarette rod, whereby the porous (tea bag-like) paper or highly porous paper fleece encases the tobacco as an inner layer and, without gluing to the outside layer, the process continues on cigarette rod machines in a customary fashion. By appropriately adapting the two hollow cylinder-type surfaces or peripheries of the two cigarette rod coverings to each other, a fold- and crease-free, double-layered cigarette rod is likewise produced, which does not differ in purely superficial terms from a traditional cigarette rod.

Processing can alternatively be also carried out in two process steps. For example, the highly porous paper fleece is connected to the outer paper in a preceding step by laminating or gluing over the whole surface or only at certain points. In the second processing step, the rod is formed in the usual manner on a cigarette rod machine.

If the cigarette rod is prepared according to the first-named method by covering with the two separate papers, the microcapsules can also be applied onto the (tea bag-like) paper or highly porous paper fleece directly prior to the preparation at the cigarette machine by spraying the capsule slurry onto the paper. Suitable devices for this are available on the market.

The advantages of an aroma mixture according to the invention can also be achieved with a tobacco cartridge (fine-cut twist) if the aroma mixture is applied onto the tobacco cartridge covering material (tea bag-like paper or highly porous paper fleece) in their production. Analogously, an empty (filter) tube can also be used by the consumer as a carrier for an aroma mixture for making a cigarette individually.

In all cases, an aroma mixture according to the invention can be applied in encapsulated or unencapsulated form onto the appropriate paper layer, or be incorporated in the paper material or cellulose fibre material which can consist of pure tobacco cellulose.

Through the use of the aroma mixture according to the invention, upon introduction into or application onto the cigarette rod covering, particularly when using the microencapsulated form, in the production of a cigarette, tobacco cartridge (fine cut twist) or filter tube, there is a compensation of the negative side-stream smoke properties when the finished product, i.e. the prepared cigarette, glows, so it appears that only a little smoking has occurred. The invention is described in the following with reference to the following examples.

Example 1

Aroma mixture 1

5.00% 4-hydroxy-2,5-dimethyl-3(2H)-furanone (Furaneol®)

2.50% vanillin 4.00% heliotropin 0.15% vanitrop (trans-2-ethoxy-5(1-propenyl) phenol)

0.80% homofuranol 0.50% benzaldehyde 2.00% cinnamon extract 2.50% anisaldehyde 18.00% cumarin flavor, Messrs. Givaudan 4.55% 1,2-propylene glycol Remaining content, alcohol (ethanol)

The above aroma mixture was applied directly onto cigarette paper 1 (Table 1, numbers 1–3) by coating or spraying. Application can be carried out either in a separate procedure or directly at the cigarette machine. Although some of the volatile fragrances are lost in the necessary drying process, a product is obtained which, upon smoking, produces a considerably improved side-stream smoke.

It is a disadvantage of this application that the aromas migrate into the tobacco rod while the manufactured cigarette is in storage. The overall effect is thus altered: the main-stream smoke is more strongly modified than desired and the effect of the aroma on the side-stream smoke is reduced.

Example 2

The aroma mixture according to Example 1 is converted in a manner known in the art to an oil-soluble form. To improve the solubility, small quantities of benzyl alcohol, benzyl benzoate and/or triacetin may be added. The aroma obtained is micro-encapsulated according to processes known in the art. The microcapsules have a diameter of 8–30 micrometers, preferably 10 to 20 micrometers. For hardening the capsules, tannin, but under no circumstances formaldehyde or glutaraldehyde, may be used. The melting point of these capsules is higher than 150° C.

The aroma capsules are applied to the cigarette paper by coating or spraying, or may be incorporated in the substance of the tobacco covering. When smoked, the cigarettes produced with this paper (Table 1, number 4) give a significantly improved side-stream smoke. It is a disadvantage of this application that so-called condensate strips arise on burning, causing the product to take on an unappealing appearance (in the case of single-layered cigarette paper, brown stripes). A second disadvantage is that the number of draws is increased proportionately according to the capsule concentration on the paper, caused by the melting of the capsules by the approaching glow and the reduction of the paper porosity associated therewith.

Example 3

The capsules described above are used in the same way as in Example 2 with a highly porous paper (Table 1, numbers 5–7). Cigarettes with a double-layered paper covering are therefore produced. The double-layered structure is achieved a) by directly processing 2 papers at the cigarette machine (Table 1, number 1 and number 8), b) by laminating the porous paper onto a normal cigarette paper (Table 1, number 1 and number 9) and c) by inserting cartridges which are covered with the porous paper into purchasable cigarette tubes.

Most types of cigarettes found on the market, as well as the tobacco mixtures used in them, can be used as tobacco rod. The application according to the invention is equally effective for both non-filter cigarettes and filter cigarettes in any format.

The cigarettes produced with these papers are considered significantly more pleasant than normal cigarettes in terms of side-stream smoke (Table 2). The main-stream smoke of these cigarettes varies slightly from a comparison cigarette without added aroma.

The cigarettes have neither draw numbers nor condensate stripes differing from the comparison cigarette.

Example 4

The microcapsules from Example 2 are present in a slurry. As a rule, the capsules settle toward the bottom. In order to guarantee a uniform layer when coating highly porous paper - analogous to Example 3 -, a medium-viscosity stable suspension is made using a 1–5% Na alginate solution, viscosity 350–850 mPa/s, which guarantees a uniform application of 0.5 to 50 g/m$^2$, in Example 4 of 30 g/m$^2$. The cigarettes prepared from this paper have approximately the same properties as those in Example 3.

Example 5

The microcapsules from the slurry are dried by drying processes known in the art, i.e. spray-drying, and incorporated in dried form preferably into the material of the highly porous paper of a double-layered cigarette rod covering. The thus-incorporated aroma mixtures permit a more odorless processing and save the additional step of applying the aroma mixture on the cigarette rod covering. Cigarettes prepared in this way have the same properties as those in Example 3.

Example 6

The aroma from Example 1 is produced without solvent and is encapsulated. A concentration is thus achieved requiring extraordinarily small quantities of microcapsules for aromatization. Negative effects, as described in Example 2, are thus reduced; but cigarettes prepared in this way otherwise retain the same sensory results as comparison cigarettes.

TABLE 1

Overview of the papers used in the examples as carriers of the aroma mixture.

| No. | Paper Descr. | Starting Porosity (CORESTA) | Final Porosity (CORESTA) | Surface Weight (g/m$^2$) | Used in Example |
|---|---|---|---|---|---|
| 1 | Cigarette paper | 24 | | 25 | 1 |
| 2 | " | 40 | | 25 | 1 |
| 3 | " | 60 | | 25 | 1 |
| 4 | " | | 24 | 35 | 2 |
| 5 | Tea bag-like paper or highly porous paper | 10,000 | 2,400 | 18 | 3 |

TABLE 1-continued

| No. | Paper Descr. | Starting Porosity (CORESTA) | Final Porosity (CORESTA) | Surface Weight (g/m²) | Used in Example |
|---|---|---|---|---|---|
| | Overview of the papers used in the examples as carriers of the aroma mixture. | | | | |
| | fleece | | | | |
| 6 | Tea bag-like paper or highly porous paper fleece | 24,000 | 9,400 | 12 | 3 |
| 7 | Tea bag-like paper or highly porous paper fleece | 47,000 | 27,000 | 12 | 3 |
| 8 | Tea bag-like paper or highly porous paper fleece | 50,000 | 28,000 | 12 | 3 |
| 9 | Tea bag-like paper or highly porous paper fleece | 48,000 | 24,000 | 12 | 3 |

We claim:

1. A cigarette including a tobacco rod provided with a cigarette rod covering, improved in that an aroma mixture is applied to the cigarette rod covering, the aroma mixture comprising:

(a) one or more aldehydes, selected from the group consisting of saturated, mono- and polyunsaturated aliphatic, alicyclic and aromatic aldehydes containing 4 to 12 carbon atoms;

(b) one or more heterocyclic compounds which contain oxygen or nitrogen as the hetero atoms(s) and at least one hydroxy group or one methyl group, selected from the group consisting of mono- and oligocyclic heterocycloalkanes, heterocycloalkanes and heteroaromatics; and (c) vanillin, and the cigarette rod covering is double-layered, including an inner layer having the aroma mixture applied thereto and which comprises a highly porous covering paper with an air permeability of 4,000 to 80,000 CORESTA prior to application of the aroma mixture, and an outer layer comprising cigarette paper with an air permeability of 5 to 100 CORESTA, wherein the aroma mixture is applied to the inner layer in encapsulated form, whereby the tobacco rod remains essentially free of the aroma mixture and the side-stream smoke is given a tobacco-like odor.

2. The cigarette according to claim 1, wherein the mixture contains one or more alcohols containing 7 to 12 carbon atoms selected from the group consisting of saturated, mono- and polyunsaturated aliphatic, alicyclic and aromatic alcohols.

3. The cigarette according to claim 1, wherein the mixture contains one or more carboxylic acid esters, wherein the ester is of the general formula $$\begin{array}{l} OR' \\ | \\ R-C=O, \end{array}$$

wherein R is a hydrocarbon consisting of 2 to 8 carbon atoms and R' is an alkyl group consisting of 1 to 5 carbon atoms.

4. The cigarette according to claim 1, wherein the mixture contains one or more saturated carboxylic acids having 4 to 6 carbon atoms.

5. The cigarette according to claim 1, wherein the mixture contains one or more aroma extracts.

6. The cigarette according to claim 1, wherein the mixture contains heliotropin.

7. The cigarette according to claim 1, wherein the mixture contains maltol.

8. The cigarette according to claim 1, wherein the mixture contains nicotine.

9. The cigarette according to claim 1, wherein the mixture contains one or more of additives selected from the group consisting of (d) alcohols containing 7 to 12 carbon atoms selected from the group consisting of saturated, mono- and polyunsaturated aliphatic, alicyclic and aromatic alcohols;

(e) carboxylic acid esters, wherein the ester is of the general formula $$\begin{array}{l} OR' \\ | \\ R-C=O, \end{array}$$

wherein R is a hydrocarbon consisting of 2 to 8 carbon atoms and R' is an alkyl group consisting of 1 to 5 carbon atoms;

(f) saturated carboxylic acids, wherein the acid contains 4 to 6 carbon atoms;

(g) aroma extracts;

(h) heliotropin;

(i) maltol; and (j) nicotine.

10. The cigarette of claim 9, wherein the aroma mixture consists essentially of up to about 40 wt. % of (a) to (j), and the balance is ethanol.

11. A cigarette including a tobacco rod provided with a cigarette rod covering, improved in that an aroma mixture is applied to the cigarette rod covering, the aroma mixture consisting essentially of one or more aldehydes of lower hydrocarbons, one or more heterocyclic compounds containing oxygen or nitrogen as hetero atom(s), and vanillin or derivatives thereof having comparable fragrance properties, each having boiling points between 80° C. and 250° C., and the cigarette rod covering is double-layered, including an inner layer having microcapsules containing the aroma mixture applied thereto and which comprises a highly porous covering paper with an air permeability of 4,000 to 80,000 CORESTA prior to application of the aroma mixture, and an outer layer comprising cigarette paper with an air permeability of 5 to 100 CORESTA, whereby the tobacco rod remains essentially free of the aroma mixture and the side-stream smoke is given a tobacco-like odor.

12. The cigarette of claim 11, wherein the boiling points range between 130° C. and 160° C.

* * * * *